US009067337B2

(12) United States Patent
Nagasaki

(10) Patent No.: US 9,067,337 B2
(45) Date of Patent: Jun. 30, 2015

(54) IMAGE FORMING APPARATUS AND STAPLER

(75) Inventor: Osamu Nagasaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 660 days.

(21) Appl. No.: 13/252,415

(22) Filed: Oct. 4, 2011

(65) Prior Publication Data

US 2012/0082497 A1 Apr. 5, 2012

(30) Foreign Application Priority Data

Oct. 5, 2010 (JP) ..... 2010-225880

(51) Int. Cl.
*G03G 15/00* (2006.01)
*B27F 7/17* (2006.01)

(52) U.S. Cl.
CPC ..... *B27F 7/17* (2013.01); *G03G 15/6544* (2013.01); *G03G 2215/00827* (2013.01)

(58) Field of Classification Search
USPC ..... 399/410
See application file for complete search history.

(56) References Cited

U.S. PATENT DOCUMENTS

| | | | | |
|---|---|---|---|---|
| 5,730,438 | A * | 3/1998 | Webb et al. | 270/58.08 |
| 7,099,605 | B2 * | 8/2006 | Namiki | 399/88 |
| 7,240,898 | B2 * | 7/2007 | Takamura et al. | 270/58.09 |
| 7,340,626 | B2 * | 3/2008 | Maitani | 713/323 |
| 8,010,007 | B2 * | 8/2011 | Sano et al. | 399/69 |
| 8,620,205 | B2 * | 12/2013 | Higashi et al. | 399/407 |
| 2002/0076232 | A1 * | 6/2002 | Taneko | 399/88 |
| 2006/0029445 | A1 * | 2/2006 | Nakamura et al. | 399/329 |
| 2008/0031651 | A1 * | 2/2008 | Watanabe et al. | 399/88 |

FOREIGN PATENT DOCUMENTS

| | | | |
|---|---|---|---|
| CN | 101008800 | A | 8/2007 |
| JP | 04-344294A | A | 11/1992 |
| JP | H06-115276 | A | 4/1994 |
| JP | 3091549 | B2 | 9/2000 |
| JP | 2005-059517 | A | 3/2005 |
| JP | 2005-102026 | A | 4/2005 |
| JP | 2005-104684 | A | 4/2005 |
| JP | 2005-107322A | A | 4/2005 |
| JP | 2006-133614 | A | 5/2006 |
| JP | 2007-261700 | A | 10/2007 |
| JP | 2008-009112 | A | 1/2008 |

* cited by examiner

*Primary Examiner* — Anthony Nguyen
(74) *Attorney, Agent, or Firm* — Canon USA Inc. IP Division

(57) ABSTRACT

An image forming apparatus having a stapler includes an image forming unit configured to form an image on a recording material, a power source configured to supply electric power to the image forming unit and the stapler, and a control unit configured to control the operation of the stapler. In the image forming apparatus, a time period for prohibiting the operation of the stapler is set such that a total of a power consumption of the image forming unit and a power consumption of the stapler is equal to or less than an electric power the power source can supply so as to perform the operation of the stapler and the operation of the image forming unit partially in parallel with each other.

20 Claims, 13 Drawing Sheets

IMAGE FORMING APPARATUS AND STAPLER

BACKGROUND OF THE INVENTION

1. Field of the Invention

The present invention relates to an image forming apparatus provided with a stapler capable of performing stapling processing, for example, in arbitrary timing on a recording material with an image formed thereon, and a method for controlling power supply to the stapler.

2. Description of the Related Art

In image forming apparatuses such as a printer and a copying machine, an apparatus having a stapler for stapling an end part of a bundle of a plurality of sheets (printed recording materials) has been known. Further, an apparatus is known which can be separately provided with a stapler as an optional device to be connected to the image forming apparatus. A user can perform stapling of recording material sheets in arbitrary timing. To supply electric power to these staplers, for example, a power source provided with a dedicated adapter for converting commercial alternating current (AC) voltage into direct current (DC) voltage, or a power source that shares power with an image forming apparatus, and generates and supplies DC voltage from the power source are used.

In the former power source, since a dedicated power source for the stapler is provided, the power source is required to supply only electric power necessary for the stapler, and the design is easy. However in this case, since the power source is provided separately from the power source of the image forming apparatus, costs of the apparatus increase, or the size of the power source of the apparatus increases. This hinders reduction in costs or reduction in size. On the other hand, in the latter case, the power source of the image forming apparatus and the stapler is shared. Accordingly, as compared to the former case, the reduction in costs or the reduction in size can be easily achieved. In the latter case, however, if the stapling processing is performed in arbitrary timing, power supply timing control is necessary. For example, control has to be performed to prevent the timing of the stapling processing from overlapping with that of image forming operation in the image forming apparatus.

The stapler uses a direct current (DC) motor as a drive unit for operating a mechanism portion for stapling. By driving and rotating the DC motor, driving force is applied to a cam or a gear in the mechanism portion to perform the stapling. In such a stapler, for example, if an unusual condition such as an overcurrent occurs, in order to prevent damage in the power source circuit or the mechanism portion, or in order to reduce the power consumption, a circuit for limiting the current running through the DC motor to a constant value or less or a current interruption circuit for interrupting the current running in the stapler are provided. For example, Japanese Patent Application Laid-Open No. 2008-9112 proposes a configuration of sharing a power source of an image forming apparatus and connecting a current limiting circuit between a stapler and the power source. The power source is configured to control overcurrent such as inrush current using the current limiting circuit to respond flexibly to the load change.

In the above-described case, that is, in the configuration of sharing the power source of the image forming apparatus with the stapler, if the timing when the stapler operates is known in advance, it is easy to control or stop the operation. However, if the user executes the stapling processing in arbitrary timing, it is necessary to prevent the processing from overlapping with the image forming operation. To solve the problem, the following methods can be applied:

(1) separate the execution timings such that the stapling processing and the image forming operation are not simultaneously performed, or (2) set a part of a time period for prohibiting the stapling processing (time period the load increases) in the image forming operation such that power consumption does not exceed the capacity of the power source.

In the method (1), if an instruction of implementing the stapling processing is issued in arbitrary timing, the current for the stapling processing may not be sufficient at the timing, and then, the stapling processing may be suspended. This may cause decrease in the productivity in the stapling processing. In the method (2), during the stapling processing, the operation may be prohibited. For example, if the operation is stopped in the middle of stapling, the staple may be stuck (occurrence of so-called staple jam).

SUMMARY OF THE INVENTION

The present invention is directed to preventing reduction in productivity in stapling processing performed in arbitrary timing with an inexpensive small power source in a case where an apparatus is provided with a stapler.

According to an aspect of the present invention, an image forming apparatus having a stapler for stapling recording materials is provided. The image forming apparatus includes an image forming unit configured to form an image on the recording material, a power source configured to supply electric power to the image forming unit and the stapler, and a control unit configured to control the operation of the stapler. The control unit sets a time period for prohibiting the operation of the stapler such that a total of a power consumption of the image forming unit and a power consumption of the stapler is equal to or less than an electric power the power source can supply so as to perform the operation of the stapler and the operation of the image forming unit partially in parallel with each other.

According to another aspect of the present invention, a stapler connected to an image forming apparatus, operating with electric power supplied from a power source in the image forming apparatus, and capable of performing a stapling processing on recording materials in arbitrary timing is provided. The stapler includes a control unit configured to control the stapling processing. The control unit sets a time period for prohibiting the operation of the stapler such that a total of a power consumption of the image forming unit and a power consumption of the stapler is equal to or less than an electric power the power source can supply so as to perform the operation of the stapler and the operation of the image forming unit partially in parallel with each other.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinafter, configurations and operation according to exemplary embodiments of the present invention will be described. The following exemplary embodiments are only examples, and the technical scope of the present invention is not limited to the exemplary embodiments.

Figure 1:
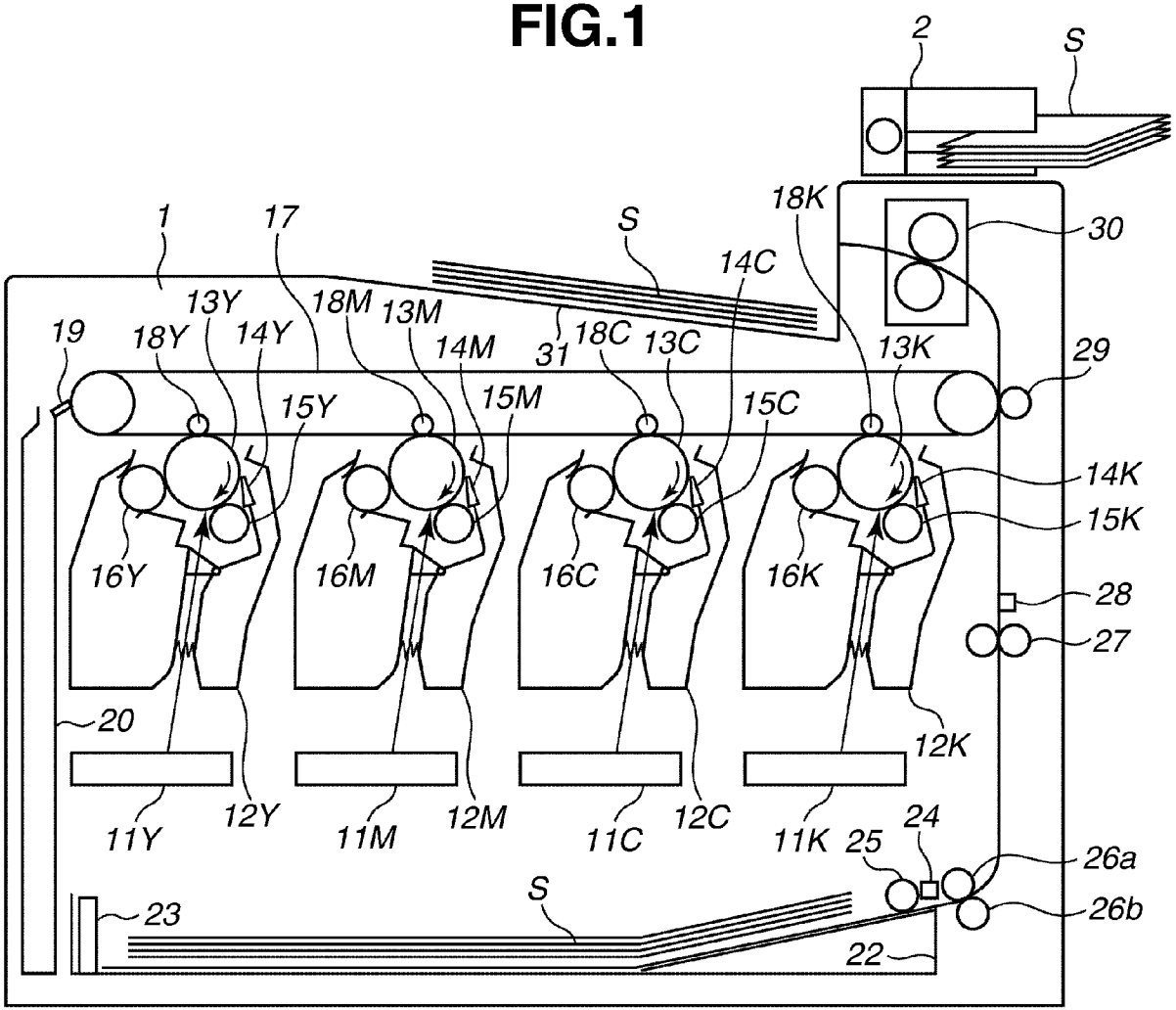
FIG. 1 illustrates an overall configuration of an image forming apparatus.

A first exemplary embodiment is described as follows. FIG. 1 is a cross-sectional view illustrating a laser beam printer 1 that is an example of an image forming apparatus according to the first exemplary embodiment. The laser beam printer illustrated in FIG. 1 has a stapler 2 that is connected and mounted to an upper part of the printer. A power source of the stapler 2 is shared with the laser beam printer. A user can execute a stapling processing in arbitrary timing using the stapler 2.

In FIG. 1, reference numeral 1 denotes the laser beam printer body (hereinafter, referred to as printer body). The printer is of an in-line type, having image forming units for forming toner images of four colors of yellow (Y), magenta (M), cyan (C), and black (B) arranged in parallel, and the printer can superimpose the four-color toner images and output a full-color image. As the image forming units of each color, laser scanners (11Y, 11M, 11C, and 11K) and cartridges (12Y, 12M, 12C, and 12K) are provided. The cartridges (12Y, 12M, 12C, and 12K) include photosensitive drums (13Y, 13M, 13C, and 13K) that rotate in the arrow direction in the drawing, cleaners (14Y, 14M, 14C, and 14K) for removing toner remaining on the surfaces of the individual photosensitive drums, charging rollers (15Y, 15M, 15C, and 15K) for uniformly charging the surfaces of the individual photosensitive drums, and development rollers (16Y, 16M, 16C, and 16K) for developing latent images formed by the laser scanners on the individual photosensitive drums as toner images.

Further, the individual photosensitive members (13Y, 13M, 13C, and 13K) are disposed such that the photosensitive drums come in contact with an intermediate transfer belt 17. Primary transfer rollers (18Y, 18M, 18C, and 18K) are provided opposite to the individual photosensitive drums across the intermediate transfer belt 17.

Further, a cleaner 19 (a type of scraping the toner by a blade in contact with the intermediate transfer belt) for removing the toner remaining on the intermediate transfer belt 17 is provided. The toner scraped by the cleaner 19 is stored in a waste toner container 20. A cassette 22 for storing sheets S as recording materials is provided with a guide 23 for regulating positions of the stored sheets S and a sheet presence sensor 24 for detecting presence of the sheets S.

On a conveyance path for conveying the sheets S toward the image forming unit, a sheet feeding roller 25, a separation roller pair 26, and a registration roller pair 27 are provided. In the vicinity of the registration roller pair 27 on the downstream side in the conveyance direction of the sheets S on the conveyance path, a registration sensor 28 is provided.

Further, a secondary transfer roller 29 that comes in contact with the intermediate transfer belt 17 is provided and a fixing device 30 is provided on a downstream side from the secondary transfer roller 29 in the conveyance direction of the sheets S. The conveyance timing of the sheet S supplied by the sheet feeding roller 25 from the cassette 22 is adjusted by the registration rollers, and the image on the intermediate transfer belt 17 is transferred onto the sheet S by the secondary transfer roller. The image transferred onto the sheet S is heated and pressed by the fixing device 30, and fixed onto the sheet S. The image-formed sheet S is discharged and sequentially stacked on a discharge tray 31.

The stapler 2 that serves as a post-processing apparatus for performing stapling processing of the bundle of the image-formed sheets S is connected to the upper part of the printer body 1. The stapler 2 described in the exemplary embodiment is configured such that the user aligns the bundle of the sheets S discharged from the printer body 1 and stacked on the discharge tray and inserts the end part of the bundle into the stapler 2 in arbitrary timing to perform the stapling processing.

Figure 2:
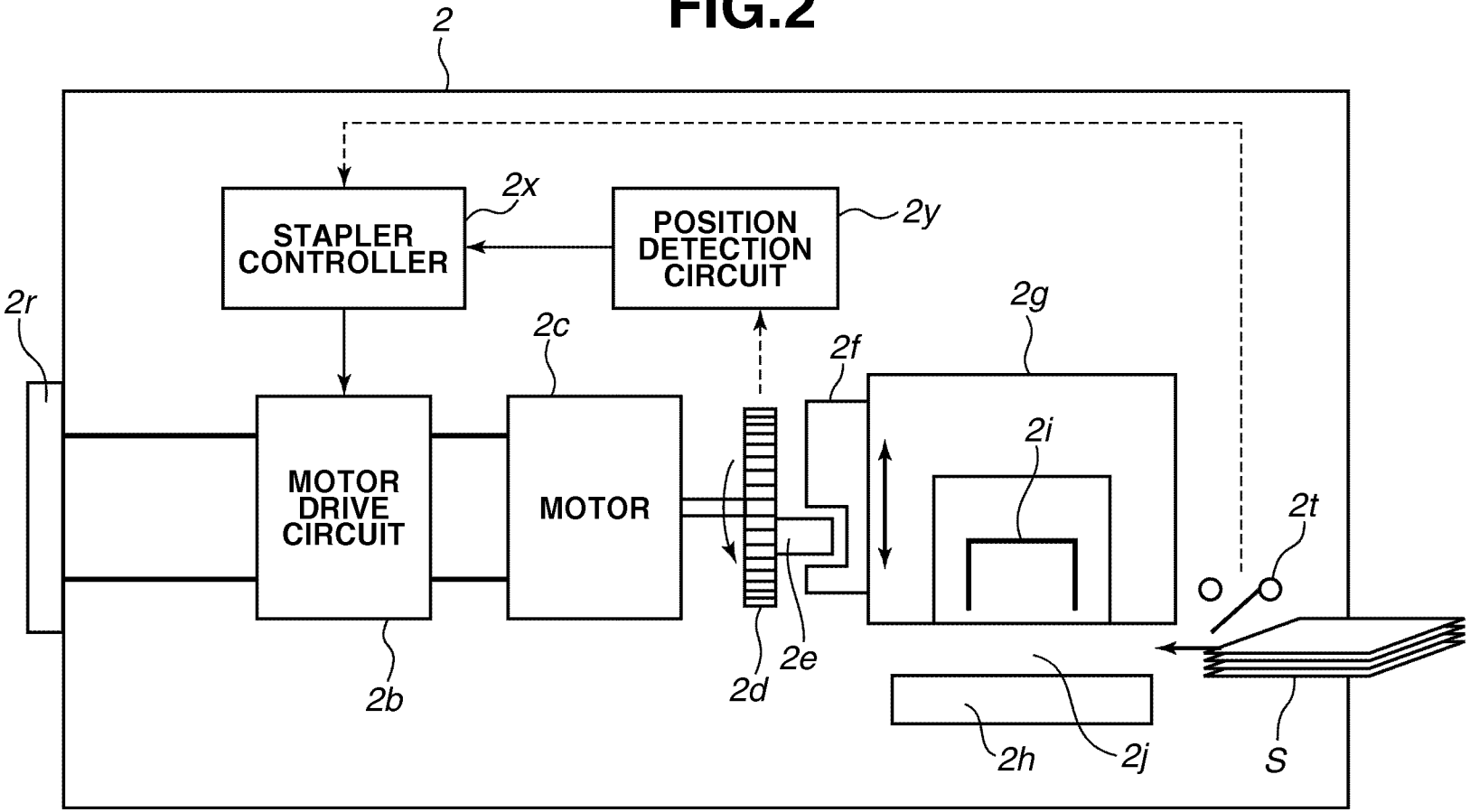
FIG. 2 illustrates a configuration of a stapler.

FIG. 2 illustrates the configuration of the stapler 2. The stapler 2 includes a connector 2*r*, a motor drive circuit 2*b*, a DC brush motor 2*c*, a gear 2*d*, a convex part 2*e*, a switching member 2*f*, a stapler bottom part 2*h*, and a staple 2*i*. The connector 2*r* connects the image forming apparatus 1 and the stapler 2 using a power line and a ground line. The gear 2*d* is mounted to a motor shaft, and the convex part 2*e* is attached to the gear. The switching member 2*f* is fixed to a stapler upper part 2*g* and engages with the convex part 2*e* to switch a rotary motion of the gear 2*d* into an upward and downward motion. The stapler bottom part 2*h* is fixed to the stapler 2, and the staple 2*i* is loaded onto an upper part of the stapler. Further, the stapler 2 includes a stapler controller 2*x* for controlling rotation operation of the DC brush motor 2*c* by outputting a signal to the motor drive circuit 2*b*, a switch 2*t* that is turned on in response to an insertion of the sheets S into a space 2*j*, and a position detection circuit 2*y* for detecting a rotation state of the gear 2*d*.

In the stapler 2, when the sheets S are inserted and the switch 2*t* is turned on, the stapler controller 2*x* acquires a rising signal from the switch 2*t*, and according to the rising signal, once, a signal is transmitted to the motor drive circuit 2*b* such that the DC brush motor 2*c* is driven. In order to detect the completion of the single drive of the DC brush motor 2*c*, the position detection circuit 2*y* detects the rotation position of the gear 2*d*. In response to the completion of the single rotation of the gear 2*d*, a signal is transmitted to the stapler controller 2*x*. After the single stapling processing is completed, when the user pulls the bundle of the sheets S and inserts the sheets S again, the stapler controller 2*x* controls the motor drive circuit such that the operation of the DC brush motor 2*c* starts again. By the above-described control, while the sheets S are being inserted, the stapling operation can be prevented from being sequentially carried out. The electric power necessary for the operation of the stapler 2 is supplied from the power source provided in the printer body 1. The position detection circuit 2*y* can be configured to detect the upward and downward motion of the switching member 2*f*.

Figure 3:
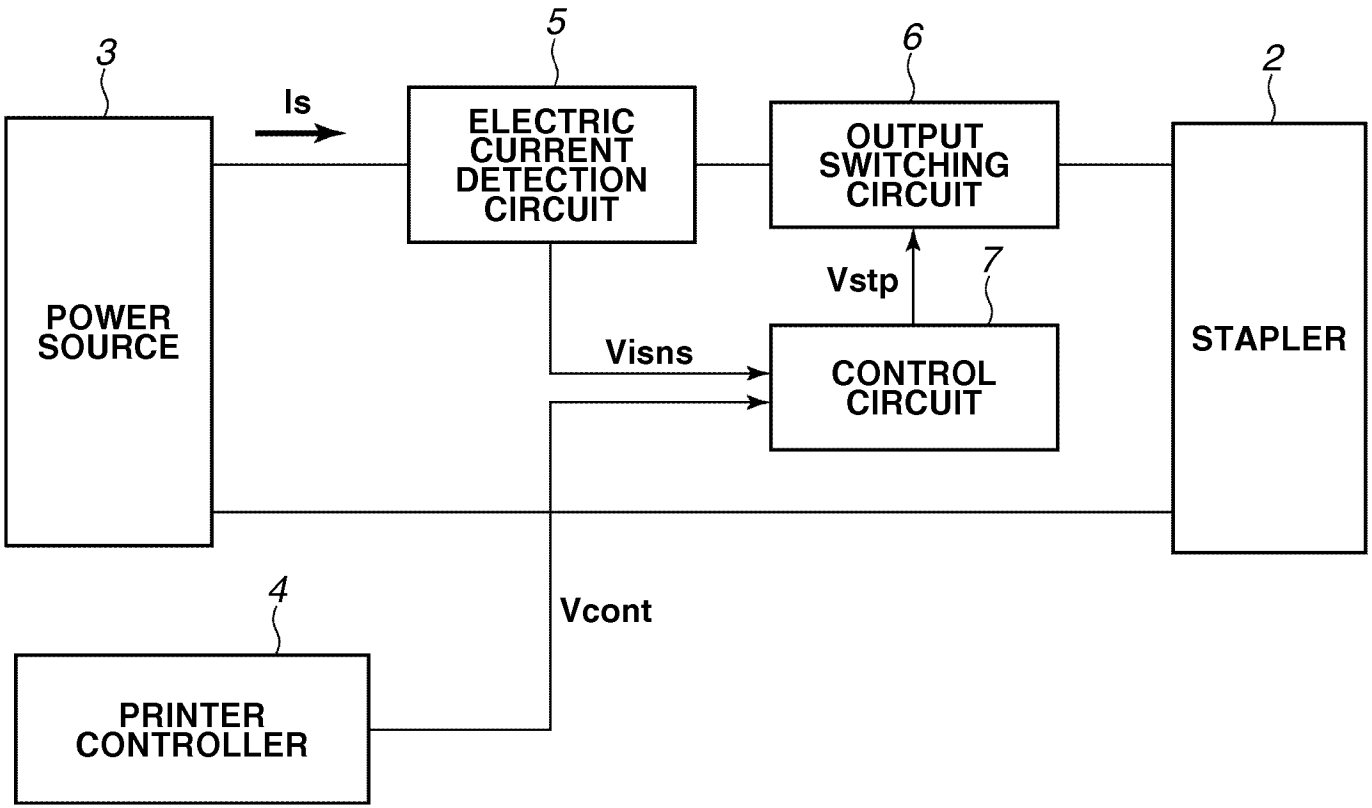
FIG. 3 is a block diagram illustrating an apparatus including a power source and a stapler according to a first exemplary embodiment.

FIG. 3 is a circuit block diagram illustrating the relationship between the stapler and the power source according to the exemplary embodiment. In FIG. 3, a power source 3, for example, converts a commercial alternating current power supply voltage (also referred to as AC voltage) into a constant DC voltage and outputs the voltage. A printer controller 4 (hereinafter, referred to as a body controller 4) controls operation of the printer. The body controller 4 includes a central processing unit (CPU), a read-only memory (ROM), and a random access memory (RAM) (not shown), and controls operation of image formation by the printer body 1. An electric current detection circuit 5 detects electric current supplied from the power source 3 to the stapler 2. A control circuit 7 switches status of a stapler operation permission signal Vstp sent to an output switching circuit 6, depending on status of an electric current detection signal Visns from the electric current detection circuit 5 or an inhibit signal Vcont from the body controller 4. The output switching circuit 6 switches permission and prohibition of current supply to the stapler 2 using the stapler operation permission signal Vstp from the control circuit 7.

Figure 4:
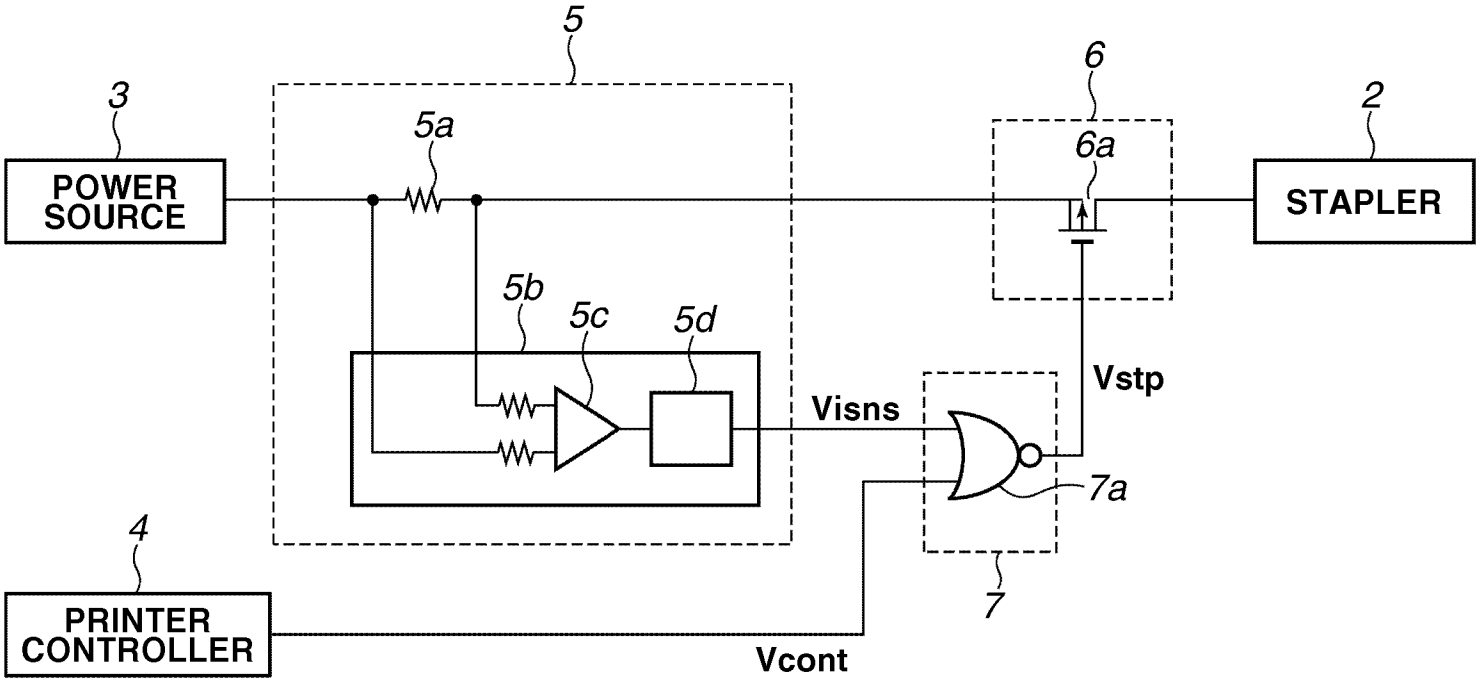
FIG. 4 is a circuit diagram illustrating the apparatus including the power source and the stapler according to the first exemplary embodiment.

In FIG. 4, in the block diagram illustrated in FIG. 3, examples of circuit configurations of the electric current detection circuit 5, the output switching circuit 6, and the control circuit 7 are specifically described. The electric current detection circuit 5 includes an electric current detection resistor 5*a* and an electric current detection amplifier 5*b*. The electric current detection amplifier 5*b* is a circuit that detects an electric current using an operational amplifier 5*c* and a current mirror circuit 5*d* and obtains an output as an electric voltage. Specifically, the electric current detection amplifier 5*b* takes a difference voltage between both ends of the electric current detection resistor 5*a* into the operational amplifier 5*c*, performs level-shift processing and amplification to perform current-voltage conversion in the current mirror circuit 5*d*, and outputs the electric current detection signal Visns.

The control circuit 7 includes a NOR circuit 7*a*. If one of the electric current detection signal Visns input from the electric current detection circuit 5 and the inhibit signal Vcont input from the body controller 4 is at a High level (hereinafter, referred to as "H" level), the control circuit 7 sets the output of the NOR circuit 7*a* to a Low level (hereinafter, referred to as "L" level). The output switching circuit 6 includes a field-effect transistor (FET) 6*a*. By the signal from the control circuit 7, the output switching circuit 6 changes a gate voltage of the FET 6*a*, and a supply current to the stapler 2 is switched. If a p-channel type FET is used as the FET, when the gate is at the "L" level, the electric current flows between the source and the drain, and the electric current is supplied from the power source to the stapler 2.

Figure 5:
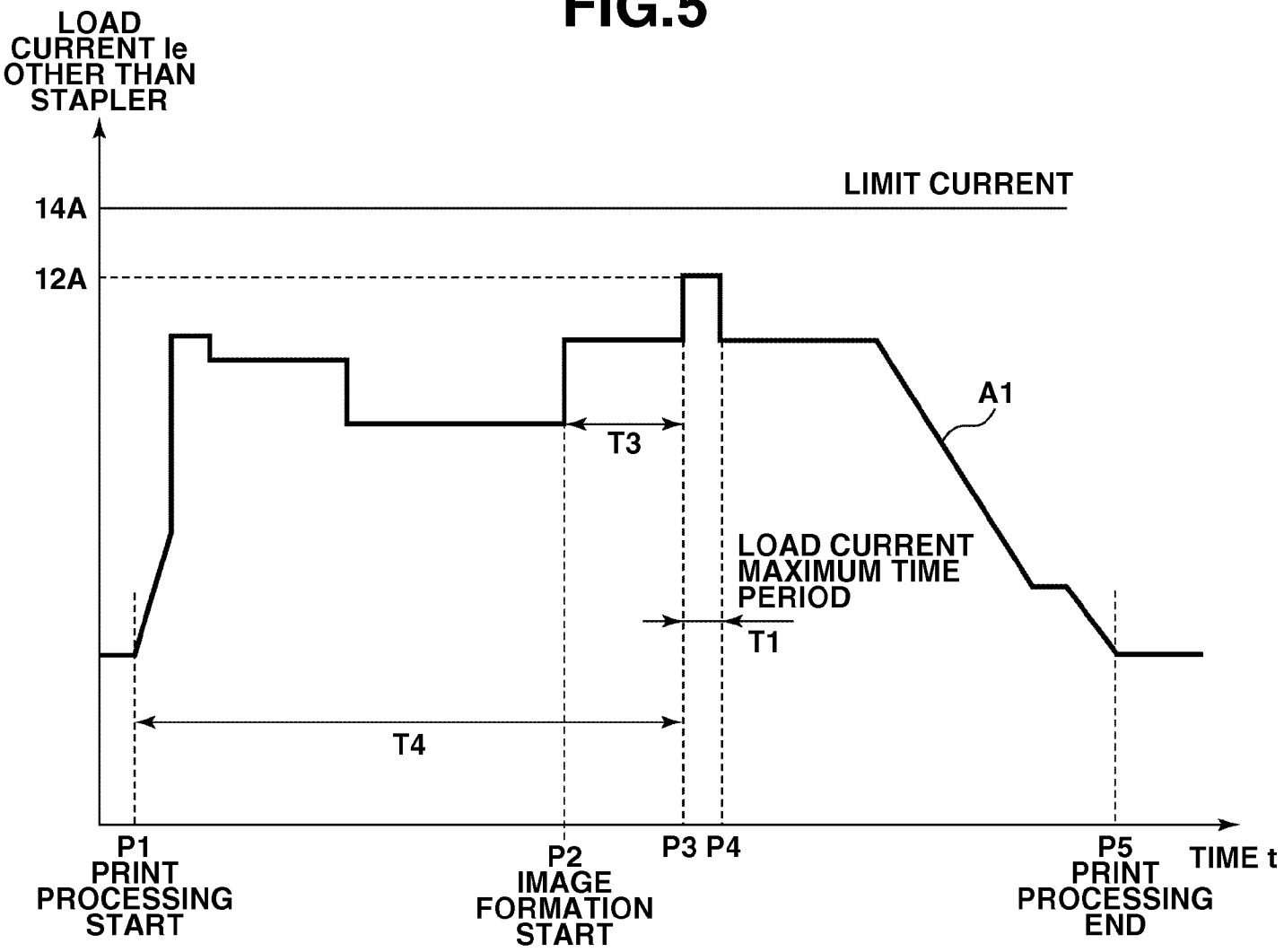
FIG. 5 is a schematic diagram illustrating a current value supplied to a load other than the stapler from the start to the end of a print processing.

FIG. 5 schematically illustrates a current value flowing through a load in the printer body 1 (other than the stapler 2) in image forming processing for implementing image formation on a sheet starting from a standby state (a state waiting for an instruction of the image formation) in the printer body 1. In the exemplary embodiment, a limit value of the supply current from the power source 3 is, for example, 14 A. The limit value can be changed depending on the specifications of the power source, regions, and regulations as needed.

First, as illustrated by a waveform A1, when the image formation starts, an initialization sequence starts. Then, a load current rapidly increases. In the sequence, as a preparatory step in the image formation, necessary operation such as adjustment of the phases of the photosensitive drums, adjustment of the temperature of the fixing device, and the like is implemented. After the completion of the initialization sequence, in response to input of image data, the image formation operation is performed. In the image forming operation, rotation of a motor for driving the laser scanners, drive start of a motor for driving a conveyance roller, and temperature adjustment of the fixing device are sequentially performed. As a result, the load current further increases.

In a time period T1 from a middle point P3 to a point P4 illustrated in FIG. 5, the load current temporarily increases to a maximum value due to drive of the motors, and the like. The point P3 is determined according to a predetermined sequence for the image formation operation, for example, after the elapse of a time period T4 from a point P1 at which the image forming processing starts, after the elapse of a time period T3 from a point P2 at which the image formation starts, or the like. In the exemplary embodiment, the maximum correction value in the time period T1 is 12 A.

Then, when the printing operation ends at a point P5, the printer enters the standby state again. More specifically, the load current value during the image forming operation in the exemplary embodiment is, while the limit current is 14 A, the maximum load current is 12 A, and a margin value (14 A−12 A) is 2 A. On the other hand, a current value necessary for the stapler 2 is 3 A at a maximum. However, the maximum load current of 12 A+stapler's maximum current value of 3 A=15 A. Therefore, the limit current of 14 A is exceeded. Next, characteristic operation in the exemplary embodiment for preventing the exceeding of the limit current is described with reference to FIG. 6. The waveform of the current value necessary in the stapler 2 is a current waveform of a triangle waveform.

Figure 6A:
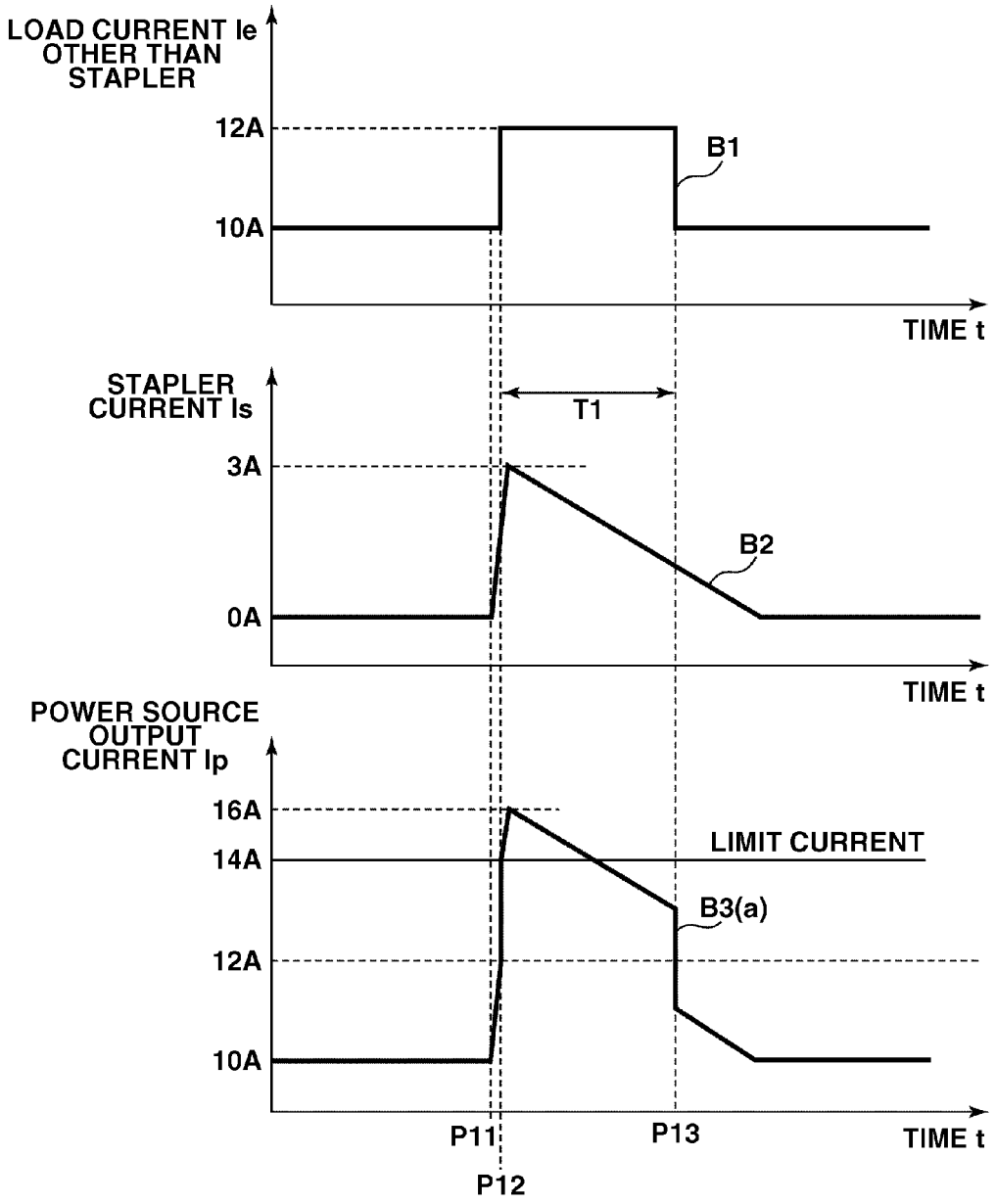
FIGS. 6A and 6B illustrate timing diagrams illustrating electric currents to the stapler and output currents and the like from a power source.
Figure 6B:
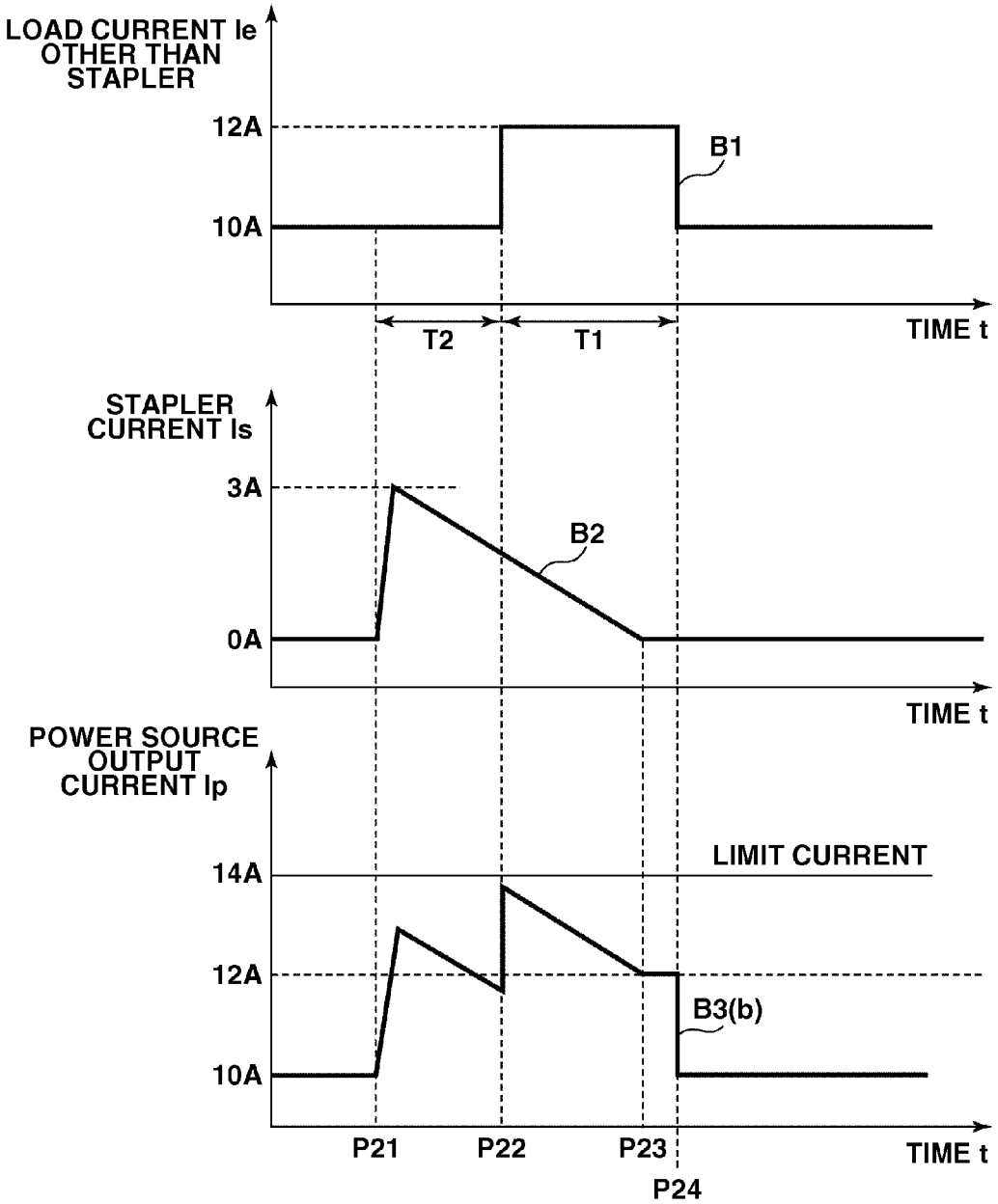

FIGS. 6A and 6B are timing diagrams schematically illustrating a current waveform B2 of an electric current Is supplied to the stapler 2, a current waveform B1 of an electric current Ie (the current value Ie illustrated in FIG. 5) supplied to a load other than the stapler 2, and a current waveform B3 of an electric current Ip output from the power source 3. In FIGS. 6A and 6B, the user implements the stapling processing in arbitrary timing in the time period T1 in which the load current reaches the maximum value in FIG. 5.

The current waveform B2 of the stapler current Is rapidly increases due to the start of the DC brush motor 2*c*, and its maximum value is 3 A. By the rotation of the DC brush motor 2*c*, the staple is driven into the sheets S. After the operation, the electric current gradually decreases, and when the value of the electric current becomes substantially 0 A and the rotation of the DC brush motor 2*c* stops, the stapling processing ends. Since the current waveform B2 largely depends on the loads, that is, the thickness and the hardness of the sheets S to be staple-processed, it is presumed that the loads reach their maximum values in the current waveform B2.

In FIG. 6A, when the load current Ie other than the stapler 2 is 10 A, if the user starts the stapling processing, at a point P11, the DC brush motor 2*c* of the stapler 2 starts to drive, and then, the stapler current Is rapidly increases. Along with the increase of Is, the output current Ip from the power source also increases. At a point P12, if the load current Ie other than the stapler increases to 12 A, the output current Ip from the power source exceeds the limit current of 14 A, and becomes 15 A. After the increase, the output current Ip from the power source varies depending on the current waveform of the stapler current Is, and at a point 13 after the elapse of the time period T1, the load current Ie other than the stapler decreases to 10 A. After the decrease, the stapling processing ends.

As illustrated in FIG. 6A, at the timing (the timing the value becomes 12 A) the load current other than the staple reaches the maximum value, if the user executes the stapling processing, the output current Ip exceeds the capacity of the power source. In such a state, the output from the power source decreases and this may cause suspension of the stapling processing or the image formation operation.

FIG. 6B illustrates the operation in the present exemplary embodiment. Different from FIG. 6A, at a point the load current Ie other than the stapler is 10 A, and before a point P22 that is the timing the load current Ie other than the stapler reaches the maximum value, a time period T2 is set. In the present exemplary embodiment, separately from the time period T1 that is a first time period, immediately before the first time period, the time period T2 is set as a second time period.

In FIG. 6B, as an example, at a point P21 before the time period T2, the user starts the stapling processing. At the point P21, the DC brush motor 2*c* of the stapler 2 starts to drive, and the stapler current Is rapidly increases. Along with the increase of the stapler current Is, the output current Ip from the power source also increases. As illustrated by a waveform B3(*b*), during the time period T2 before the load current Ie other than the stapler increases to 12 A at a point 22, the stapler current Is takes the maximum value of 3 A. The time period T2 is set such that even if the current waveform B2 of the stapler current Is has any current waveform due to the loads, the output current Ip from the power source that is the sum of the load current Ie other than the stapler and the stapler current Is, does not exceed the limit current as the capacity of the power source, which is a feature of the present exemplary embodiment. In the exemplary embodiment, 14 A is the limit value.

By setting the time period T2 as described above, in the case where the user executes the stapling processing in the time period of the time period T1+T2, the stapling processing is prohibited. In a case where the user starts the stapling processing in arbitrary timing before the time period T1+T2 or after the elapse of the time period T1, the stapling processing is permitted. Thus, control can be performed such that the output current Ip does not exceed the limit current value. Next, an example of the control method for starting the stapling processing in arbitrary timing earlier than the time period T1+T2, and prohibiting the stapling processing immediately after the completion of the stapling processing in the time period T1+T2 is specifically described with reference to FIG. 7.

Figure 7:
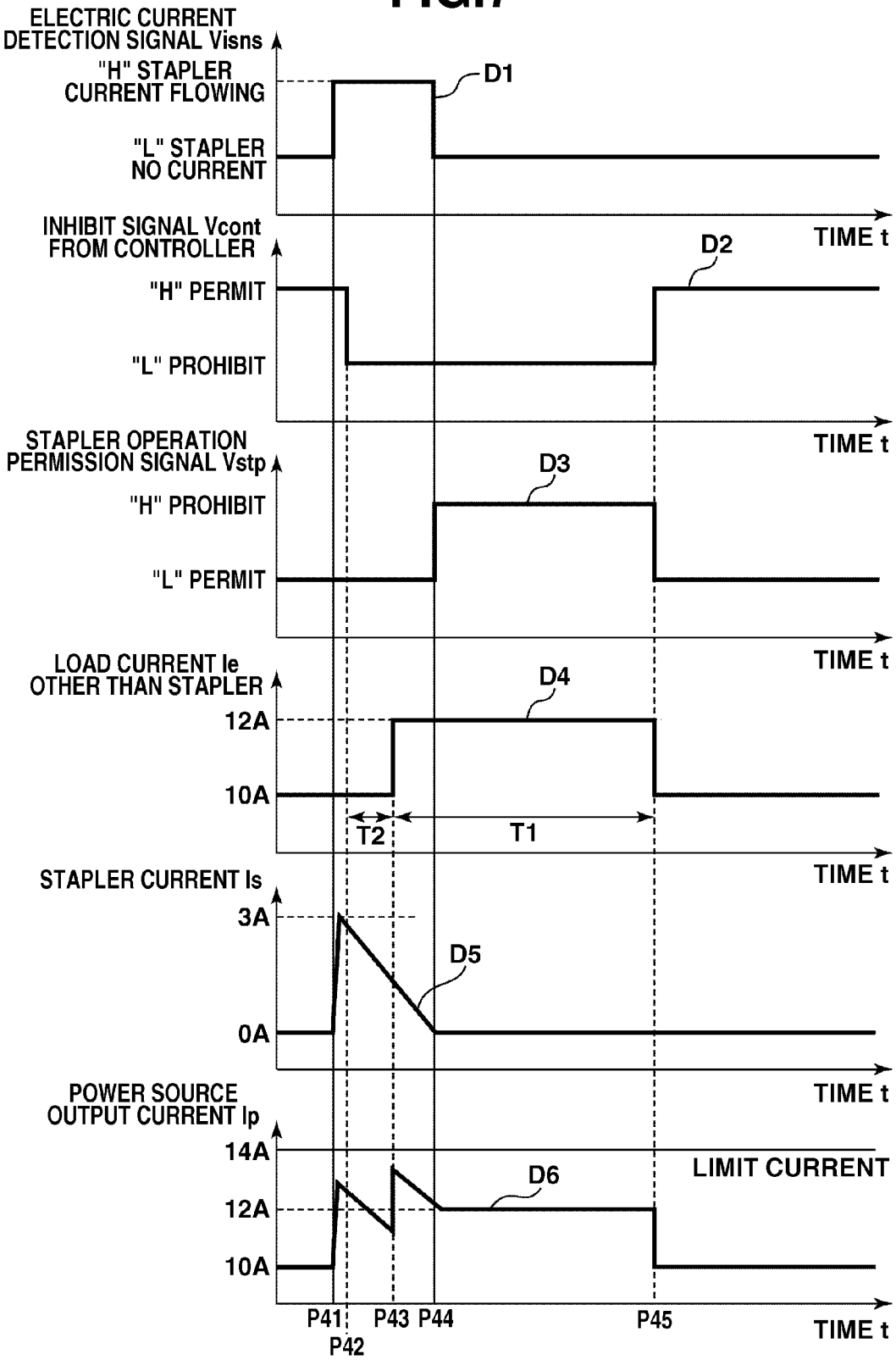
FIG. 7 is a timing diagram illustrating electric currents flowing to the stapler and output currents from the power source according to the first exemplary embodiment.

FIG. 7 is a timing diagram schematically illustrating D1 indicating the electric current detection signal Visns output from the electric current detection circuit 5 to the control circuit 7, D2 indicating the inhibit signal Vcont output from the body controller 4 to the control circuit 7, D3 indicating the stapler operation permission signal Vstp output from the control circuit 7 to the output switching circuit 6, D4 indicating the current waveform of the electric current Ie supplied to loads other than the stapler, D5 indicating the current waveform of the electric current Is running from the power source to the stapler, and D6 indicating the current waveform of the output current Ip output from the power source 3, which is the sum of the load current Ie other than the stapler and the stapler current Is.

In FIG. 7, if the stapler operation permission signal Vstp is at an "L" level, the stapling processing is permitted. If the stapler operation permission signal Vstp is at an "H" level, the stapling processing is prohibited. The electric current detection signal Visns is at an "H" level if the stapler current is running, and at an "L" level if the stapler current is not running. If the inhibit signal Vcont from the body controller 4 is at an "H" level, or the stapler operation permission signal Vstp is at the "L" level, at a point P41, the user inserts the sheets S into the stapler 2, and the stapling processing starts.

Simultaneously with the start of driving of the DC brush motor 2*c* of the stapler 2 and the start of flowing of the stapler current Is, the electric current detection signal Visns is switched from the "L" level to the "H" level. At a point P42 in the time period the stapler current Is is still flowing, the time period enters the set time period T2, and the inhibit signal Vcont from the controller is changed from the "H" level to the "L" level. This operation prohibits the stapling processing. However, the electric current detection signal Visns is still at the "H" level, and the stapler operation permission signal Vstp remains at the "H" level. In this state, the permission state of the stapling processing is maintained. At a point P43, if the load current Ie other than the stapler increases in the time period T1 and takes the maximum current value, the stapling processing is continued.

At a point P44, if the stapler current Is is 0 A, and the electric current detection signal Visns is switched from the "H" level to the "L" level, the stapler operation permission signal Vstp is changed from the "L" level to the "H" level, and the stapling processing is prohibited. After the point, at a point P45, when the load current Ie other than the stapler decreases, the inhibit signal Vcont from the body controller 4 is switched from the "H" level to the "L" level. Accordingly, the stapler operation permission signal Vstp is switched from the "H" level to the "L" level, and the stapling processing enters a permission state. The above-described flow is a series of the operation from the start to the end of the stapling processing in the exemplary embodiment. In a series of the stapling processing described in FIG. 7, as indicated by the current waveform D6, the output current Ip from the power source does not exceed the limit current value of 14 A.

As described above, according to the present exemplary embodiment, in the case where the stapling processing is started earlier than the timing the load current value other than the stapler takes the maximum value, the time period for permitting or prohibiting the stapling processing is set. By the processing, jamming of a staple or erroneous stapler operation due to suspension of the stapling processing during the stapling processing can be prevented.

Further, in the exemplary embodiment, since the stapling processing is prohibited immediately after the start of the stapling processing, the stapling operation can be prevented from starting in a time period the capacity of the power source is not sufficient. Further, the prohibition period of the stapling operation in the stapling processing can be set as short as possible. As a result, decrease in the productivity and delay of the apparatus start can be reduced. Accordingly, the usability can be increased.

The current values of various types described in the exemplary embodiment are only examples, and depending on the specifications of the apparatus, a limit current value, a maximum current value in the stapling processing, and the like can be set as needed.

The stapler described in the exemplary embodiment performs control to detect the insertion of the sheets and drive the DC motor once. However, instead of the controller in the stapler, by providing a mechanism cooperating with the detection of the sheets, the stapling processing can be implemented.

In the exemplary embodiment, the electric current detection signal is described as the digital signal, however, an analog signal can be used for the detection.

Figure 8:
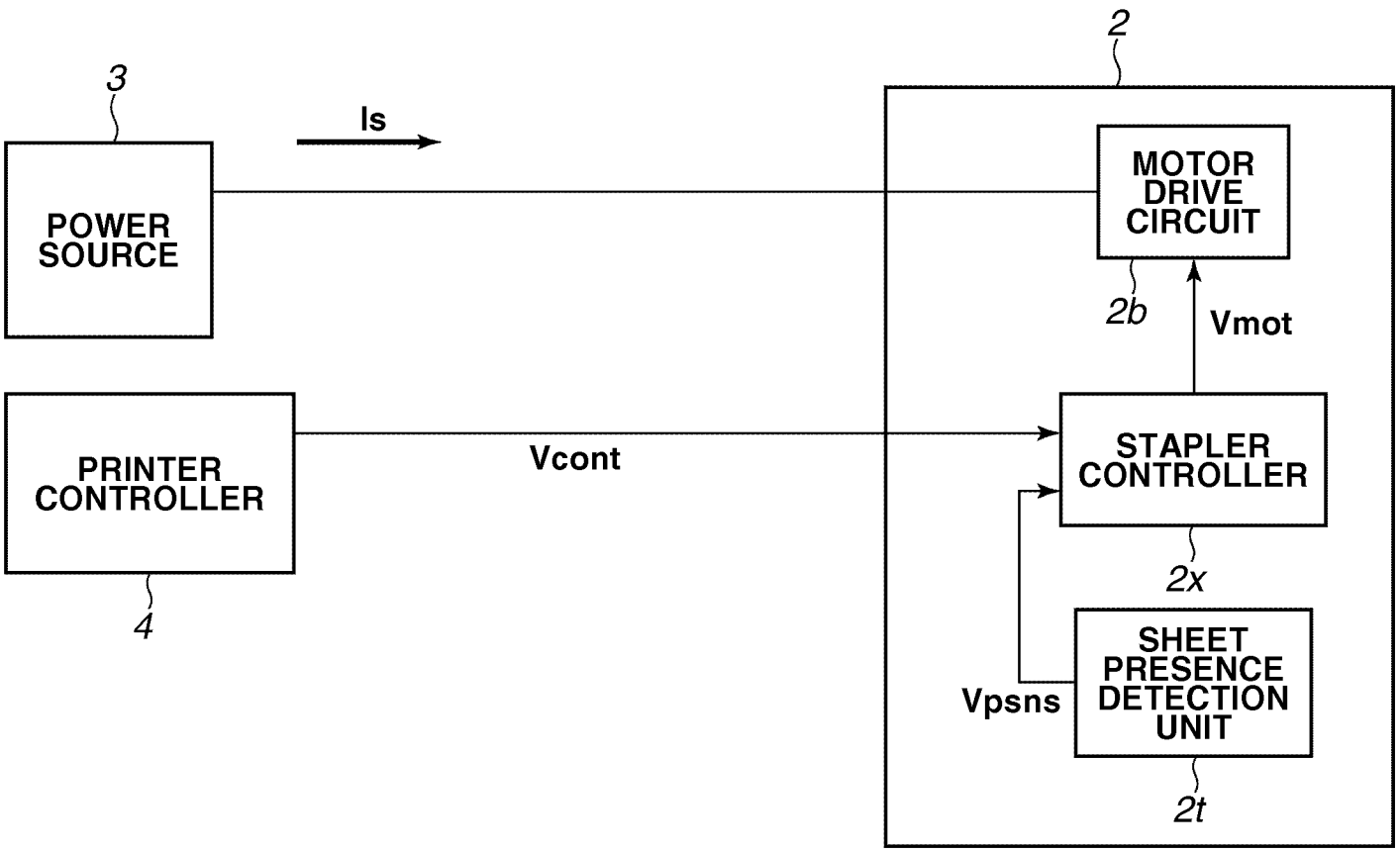
FIG. 8 is a block diagram illustrating an apparatus including the power source and the stapler according to a second exemplary embodiment.

FIG. 8 is a block diagram illustrating circuit configurations of a stapler and a power source according to a second exemplary embodiment. The same parts as those in FIG. 2 and FIG. 3 described in the first exemplary embodiment are indicated by the same reference numerals, and their descriptions are omitted. Different from the first exemplary embodiment, in the exemplary embodiment, the electric current detection circuit 5 for detecting the current Is supplied from the power source 3 to the stapler 2 is not provided, and a sheet presence detection unit 2*t* for constantly detecting whether the sheets S are inserted into the stapler 2 is provided.

In the present exemplary embodiment, depending on a detection result of the sheet presence detection unit 2*t*, control of permitting or prohibiting the stapler operation is performed. From the sheet presence detection unit 2*t* to the stapler controller 2*x* provided in the stapler 2, a sheet presence detection signal Vpsns is transmitted. In response to the sheet presence detection signal Vpsns, the stapler controller 2*x* outputs a motor drive signal Vmot for operating the motor drive circuit 2*b*. With reference to the timing diagram in FIG. 9, stapling operation performed in a case where the user executes the stapling processing of the sheets S in twice in a period including the time period T1 in which the load current takes the maximum value is described.

Figure 9:
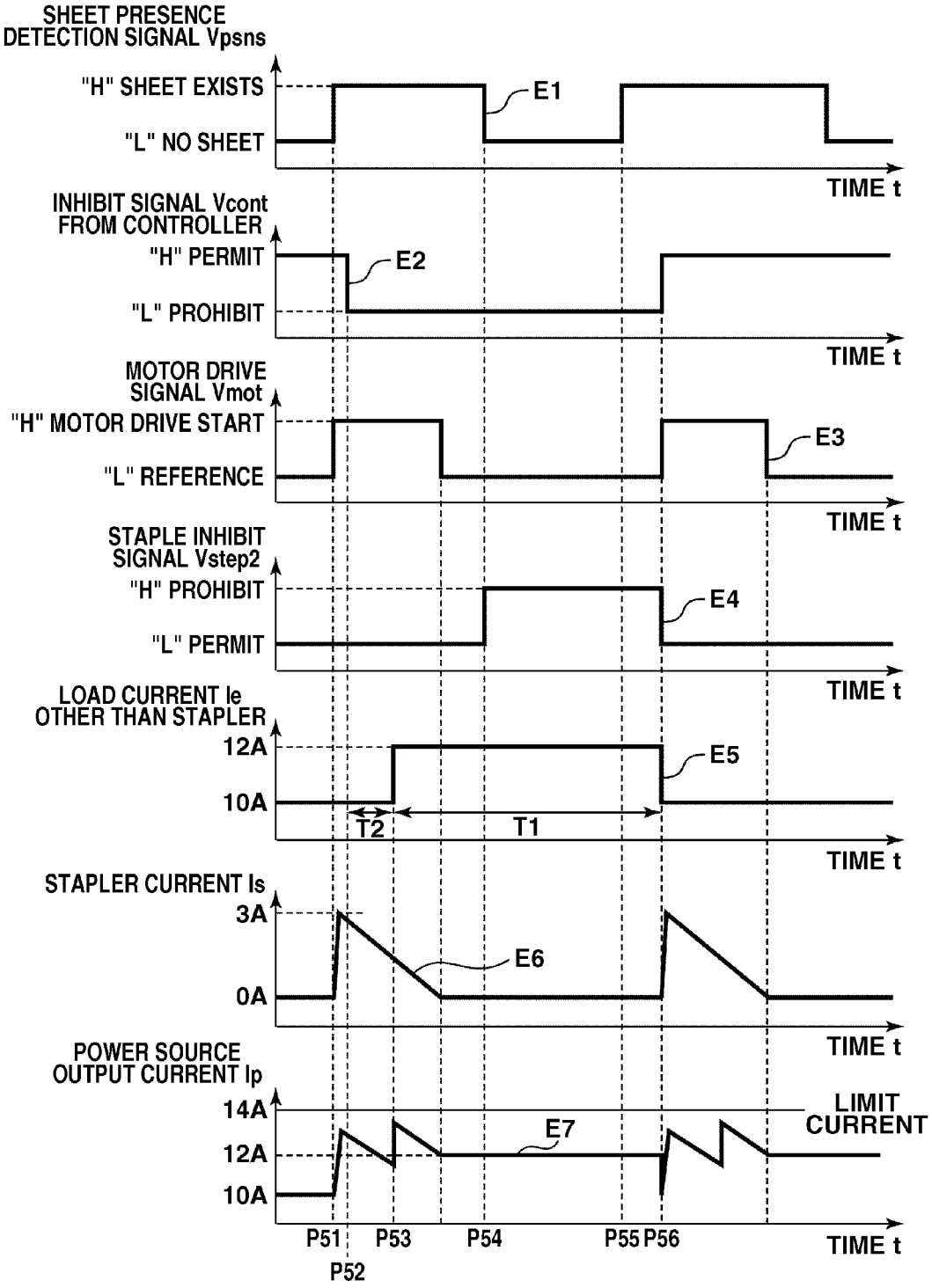
FIG. 9 is a timing diagram illustrating electric currents flowing to the stapler and output currents from the power source according to the second exemplary embodiment.

FIG. 9 is a timing diagram schematically illustrating E1 indicating the sheet presence detection signal Vpsns output from the sheet presence detection unit 2*t* to the stapler controller 2*x*, E2 indicating the inhibit signal Vcont output from the body controller 4 of the image forming apparatus to the stapler controller 2*x*, E3 indicating the motor drive signal Vmot output from the stapler controller 2*x* to the motor drive circuit 2*b*, E4 indicating a staple inhibit signal Vstep2 within the stapler controller 2*x*, E5 indicating the current waveform of the electric current Ie supplied to loads other than the stapler, E6 indicating the current waveform of the current Is running from the power source 3 to the stapler, and E7 indicating the current waveform of the power source output current Ip output from the power source 3.

The sheet presence detection signal Vpsns is at an "H" level if the sheets S as the recording materials are inserted, and at an "L" level if the sheets S are not inserted. The motor drive signal Vmot is output from the stapler controller 2*x* under conditions similar to those in the first exemplary embodiment.

If the inhibit signal Vcont from the body controller 4 is at the "H" level, and the motor drive signal Vmot is at a "L" level, at a point P51, the user inserts the sheets S into the stapler 2, and the sheet presence detection signal is switched from the "L" level to the "H" level. Simultaneously with the operation, the microcomputer 2*x* sets the motor drive signal Vmot to a "H" level, and the motor drive circuit 2*b* drives the motor. Then, the stapler current Is starts to flow in the waveform indicated by E5. At a point P52 at which the stapler current Is is flowing, the operation enters the above-described time period T2, and the inhibit signal Vcont from the controller is switched from the "H" level to the "L" level. Then, the stapling processing enters the inhibited state. However, the motor drive circuit 2*b* has already been operating, and the stapling operation is not stopped. At a point P53, even if the load current Ie other than the stapler increases in the time period T1 and takes the maximum current value, the stapling processing is continued.

If the stapling operation ends, the sheets S are pulled out of the stapler 2, and the sheet presence detection signal Vpsns is switched from the "H" level to the "L" level, since the inhibit signal Vcont is at the "L" level, the staple inhibit signal Vstep2 is set in the stapler controller 2*x*, and the stapling operation is prohibited. At a point P55, even if the user inserts next sheets S into the stapler and the sheet presence detection signal Vpsns is switched from the "L" level to the "H" level, the inhibit signal Vcont from the stapler controller 2*x* is maintained at the "L" level, and the staple inhibit signal Vstep2 in the stapler controller 2*x* maintains the inhibited state of the stapling operation. In the state the sheets S are inserted, at a point P56, if the time period T1 ends, the inhibit signal Vcont is switched from the "L" level to the "H" level, the stapling operation is permitted by the staple inhibit signal Vstep2 in the stapler controller 2*x*, and the motor drive signal Vmot is set to the "H" level. Thus, the motor is driven and the stapling operation starts. Then, the electric current of the stapler current Is increases as indicated by the waveform E6. The above-described operation is a series of the operations performed in the case where the stapling processing is sequentially performed a plurality of times by inserting and removing the sheets according to the exemplary embodiment. In a series of the stapling processing, as can be understood from the current waveform E7, the power source output current Ip does not exceed the limit current of 14 A.

In the exemplary embodiment, the switch is used for the sheet presence detection unit 2*t*. However, an optical member such as a photointerrupter can be used. By using the sheet presence detection unit 2*t*, it is not necessary to use the stapler current detection circuit, and the inexpensive configuration can be achieved. In the exemplary embodiment, the example of providing the stapler controller 2*x* in the stapler 2 to control the motor drive circuit 2*b* has been described. However, using the body controller 4, similar functions can be implemented.

Figure 10:
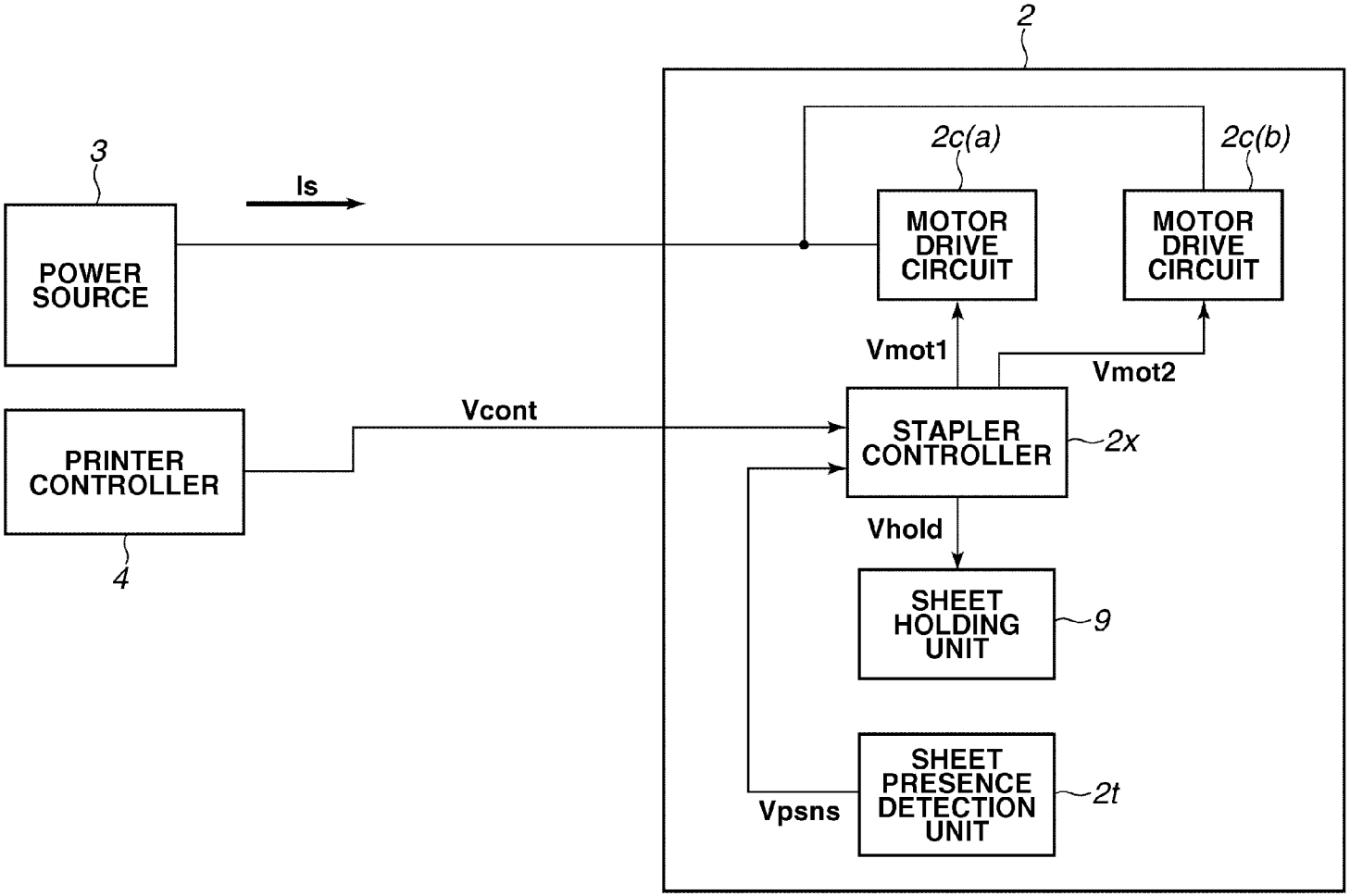
FIG. 10 is a block diagram illustrating an apparatus including the power source and the stapler according to a third exemplary embodiment.

FIG. 10 is a block diagram illustrating circuit configurations of a stapler and a power source according to a third exemplary embodiment. The same parts as those in FIG. 2, FIG. 3, and FIG. 8 are indicated by the same reference numerals, and their descriptions are omitted.

In the present exemplary embodiment, similarly to the second exemplary embodiment, using the sheet presence detection unit 2*t* for detecting whether the sheets S are inserted into the stapler 2, permitting or prohibiting of the stapler operation is controlled. Different from the second exemplary embodiment, it has a function of sequentially performing the stapling operation at different positions of the sheets S and a sheet holding unit 9 is provided which prevents the staple position from deviating from a predetermined position due to movement of the sheets S in the sequential stapling operation, and double stapling is hindered. The sheet holding unit 9 includes, for example, a clutch and a member driven by using a drive circuit for driving the clutch, and is, for example, a guide member for holding the sheets and fixing the position. For example, the guide member can be configured to hold and align the both end portions of the sheets to fix the sheets. In order to operate a drive circuit of the sheet holding unit 9, a sheet holding signal Vhold is output from the stapler controller 2*x*. The stapling operation at the different positions is implemented by two pairs of stapling mechanisms disposed at separated positions, in other words, providing two staplers 2 at different positions.

Figure 11:
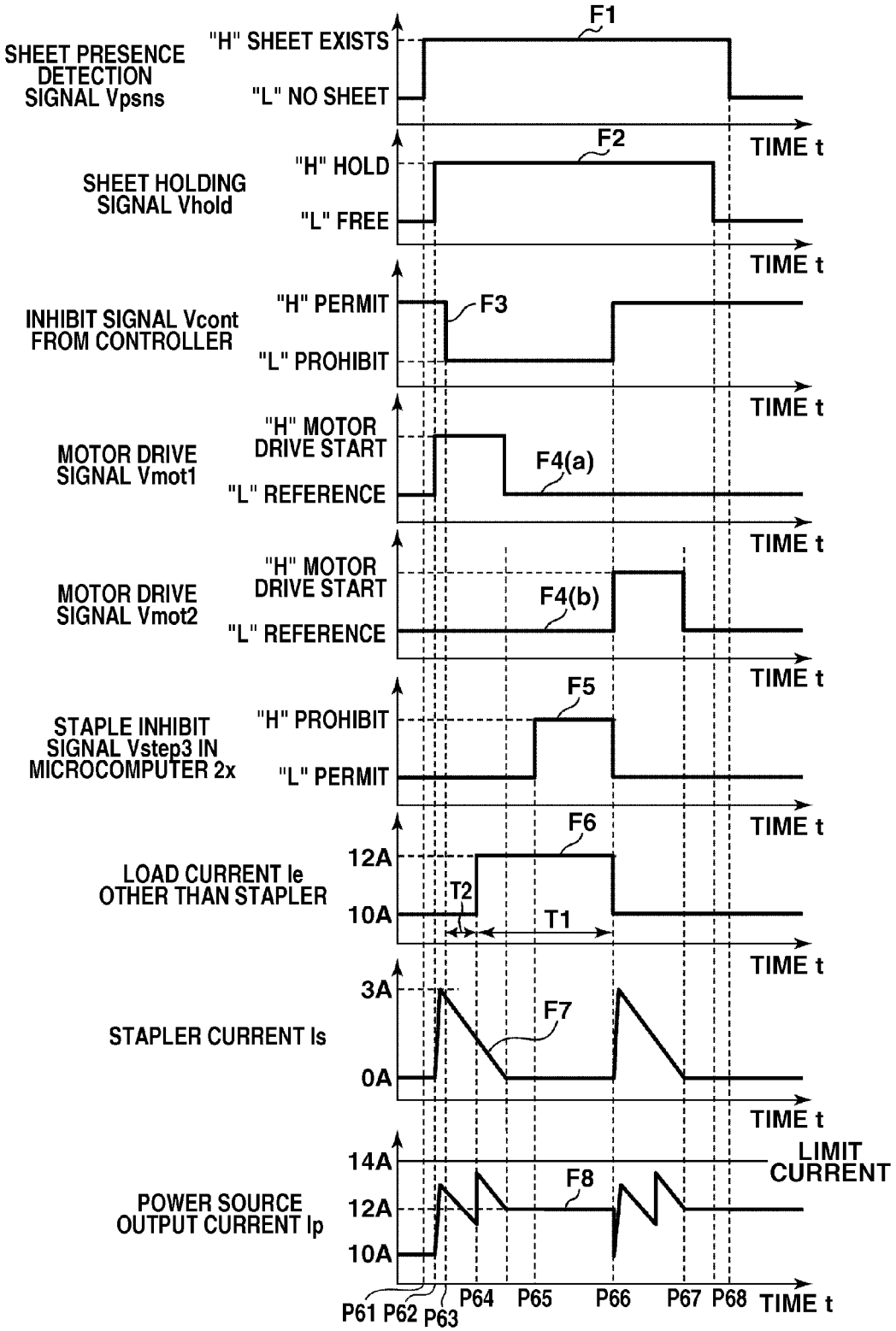
FIG. 11 is a timing diagram illustrating electric currents flowing to the stapler and output currents from the power source according to the third exemplary embodiment.

With reference to the timing diagram in FIG. 11, as an example, sequential stapling operations performed twice at the two different positions are described. FIG. 11 schematically illustrates F1 indicating the sheet presence detection signal Vpsns output from the sheet presence detection unit 2*t*, F2 indicating the sheet holding signal Vhold output from the stapler controller 2*x* to the sheet holding unit 9, F3 indicating the inhibit signal Vcont output from the body controller 4 to the stapler controller 2*x*, F4 (a) indicating a motor drive signal Vmot1 output from the stapler controller 2*x* to a motor drive circuit 2*c* (a), F4 (b) indicating a motor drive signal Vmot2 output from the stapler controller 2*x* to a motor drive circuit 2*c* (b), F5 indicating a staple inhibit signal Vstep3 set in the stapler controller 2*x*, F6 indicating the current waveform of the electric current Ie supplied to loads other than the stapler, F7 indicating a waveform of the current Is flowing from the power source 3 to the stapler 2, and F8 indicating a waveform of the power source output current Ip output from the power source 3. Similarly to the above-described exemplary embodiments, an operation performed in a case where the user executes the stapling processing in a period including the time period T1 in which the load current takes the maximum value is described.

When the sheet presence detection signal Vpsns is at the "L" level and indicates a sheet non-existence, the sheet holding signal Vhold is at the "L" level and indicates a free state where the sheets are not held by the sheet holding unit 9, the inhibit signal Vcont from the body controller 4 is at the "H" level, and the staple inhibit signal Vstep3 in the stapler controller 2*x* is at a "L" level, at a point P61, the user inserts the sheets S into the stapler 2, and the sheet presence detection signal Vpsns is switched from the "L" level to the "H" level. When the stapler controller 2*x* receives the sheet presence detection signal Vpsns, at a point P62, the stapler controller 2*x* switches the sheet holding signal Vhold from the "L" level to the "H" level to drive the sheet holding unit 9. Then, the sheets S are held and fixed by the sheet holding unit 9. Simultaneously, the stapler controller 2*x* sets the motor drive signal Vmot1 to a "H" level so that the motor drive circuit 2*c* (a) drives a motor 1 (not shown), and the first stapling operation is performed. Then, the stapler current Is flows in the waveform indicated by F7.

At a point P63 at which the stapler current Is is flowing, the operation enters the above-described time period T2, and the inhibit signal Vcont from the controller is switched from the "H" level to the "L" level, so that the stapling processing enters the inhibited state. However, the sheet presence detection signal Vpsns is still at the "H" level, and the motor drive circuit 2*c* (a) has already been operating. Accordingly, the stapling operation is not stopped. At a point P64, even if the load current Ie other than the stapler increases in the time period T1 and takes the maximum current value, the stapling operation is continued.

When the stapling operation ends, since the inhibit signal Vcont is at the "L" level, at a point P65, the staple inhibit signal Vstep3 in the stapler controller 2*x* is set to the "H" level, and the stapling operation is inhibited. During the inhibited time period, the sheet holding unit 9 continues holding the sheets S. At a point P66, if the time period T1 ends, the inhibit signal Vcont is switched from the "L" level to the "H" level, the inhibit signal Vstep3 in the stapler controller 2*x* is set to the "L" level, and the motor drive signal Vmot2 is set to the "H" level. Accordingly, the motor drive circuit 2*c* (b) drives a motor 2 (not shown) and the second stapling operation starts. Then, the electric current of the stapler current Is increases as indicated by the waveform F7.

After the second stapling operation ends, at a point P67, the sheet holding signal Vhold is switched from the "H" level to the "L" level, and the drive of the sheet holding unit 9 is stopped. Then, the sheets S are in a free state. At a point P68, the user pulls the sheets S out of the stapler 2, the sheet presence detection signal Vpsns is switched from the "H" level to the "L" level, and the stapling processing ends.

The above-described operation is a series of the operations from the start to the end of the stapling processing in the case where the stapling processing is sequentially performed a plurality of times at the different positions by one time sheet insertion according to the present exemplary embodiment. In a series of the stapling processing, as can be understood from the current waveform E8, the power source output current Ip does not exceed the limit current of 14 A.

In the present exemplary embodiment, in addition to the sheet presence detection unit 2*t*, the sheet holding unit 9 is provided. Owing to the sheet holding unit 9, the stapling processing can be performed in the state the sheets are surely fixed. Accordingly, the stapling processing can be performed such that the positions in the stapling processing do not deviate in a case where the stapling operation is performed at the plurality of positions. In the exemplary embodiment, for the sheet holding unit 9, the mechanism of driving the guide member by the clutch and the drive circuit for driving the clutch are used. However, as long as a mechanism capable of holding the sheets is employed, a configuration other than the guide member, for example, a member or a roller for holding and fixing the sheets can also be used. The plural stapling processing can also be performed using one stapler 2 by sequentially moving the stapler 2 to the stapling positions the plurality of times. Further, the user can be notified by lighting of a light-emitting diode (LED) that the stapling operation is being performed and the sheets are not to be moved, which increases its usability.

Figure 12:
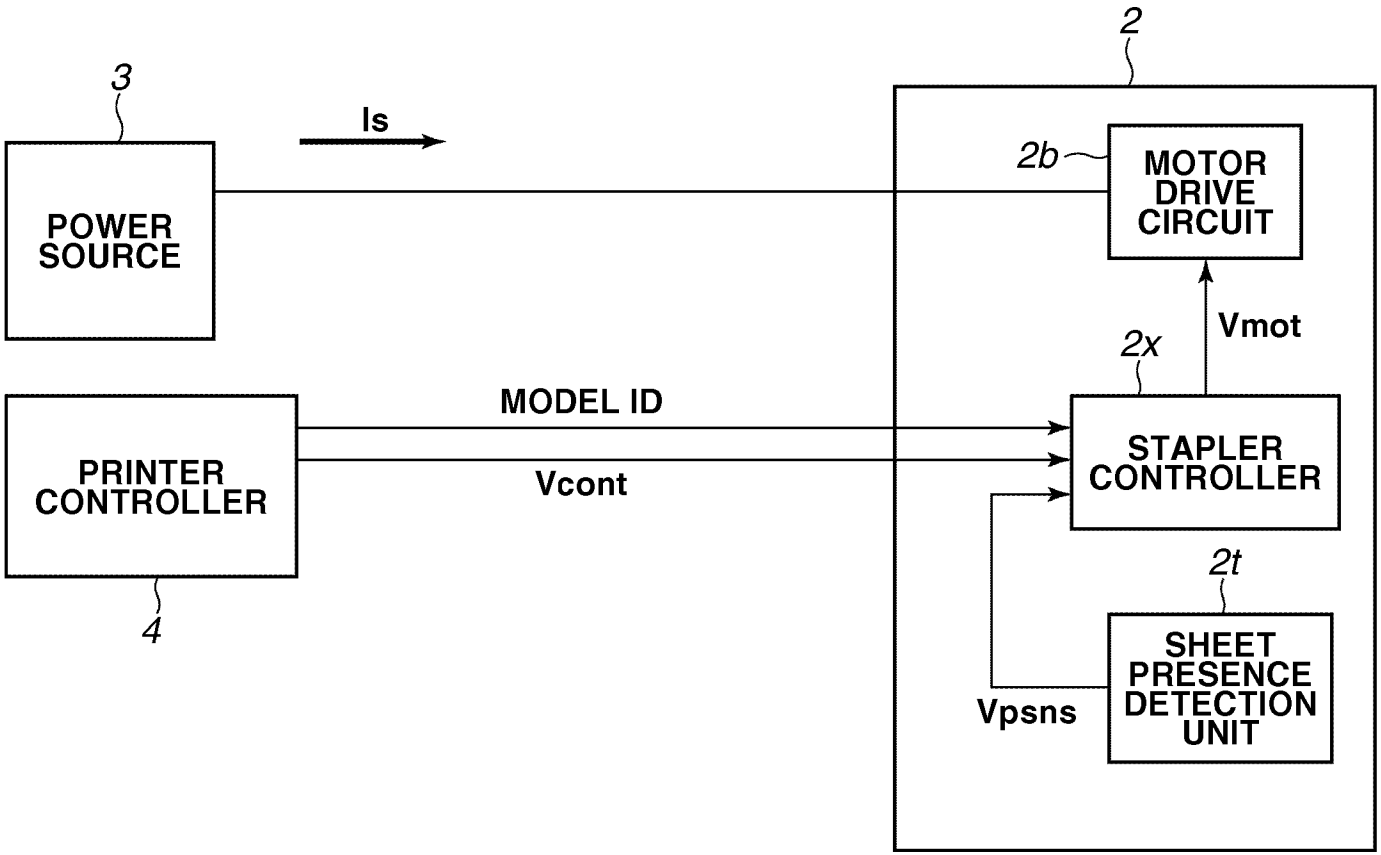
FIG. 12 is a block diagram illustrating an apparatus including the power source and the stapler according to a fourth exemplary embodiment.

FIG. 12 is a block diagram illustrating circuit configurations of a stapler and a power source according to a fourth exemplary embodiment. The same parts as those in FIG. 2, FIG. 3, and FIG. 8 are indicated by the same reference numerals, and their descriptions are omitted.

In the present exemplary embodiment, in response to a signal from the body controller 4, the stapler 2 switches the above-described time period T2. The stapler 2 is detachably connected to the image forming apparatus. For example, the stapler 2 can be connected to a plurality of types of image forming apparatuses which shows different specifications, for example, image formation speeds. In such a case, maximum load current in the image forming apparatuses to be connected to the stapler may vary. If the maximum load currents differ from each other, by switching inhibited periods to be set depending on the different maximum load currents, the inhibited periods appropriate for the individual image forming apparatuses can be set.

In the exemplary embodiment, depending on information about the type of the image forming apparatus transmitted from the body controller 4 in the image forming apparatus to which the stapler is connected, the time period T2 is switched and set. Accordingly, the period for prohibiting the stapling processing can be appropriately set depending on the difference in the maximum load current in the individual image forming apparatus.

With reference to FIG. 12, the switching operation of the time period T2 in the exemplary embodiment is described. In FIG. 12, a signal line for transmitting the information about the type of the image forming apparatus from the body controller 4 to the stapler controller 2*x* is added to the above-described FIG. 8. As an example, the stapler 2 that can be connected to an apparatus A of an image formation speed of 12 pages per minute (ppm) and an apparatus B of an image formation speed of 16 ppm is described. In such a case, if the stapler 2 is connected to the apparatus A, from a body controller 4A of the apparatus A, information of "model ID1" is transmitted. If the stapler 2 is connected to the apparatus B, information of "model ID2" is transmitted.

If the stapler controller 2*x* in the stapler 2 receives the information of the "model ID1", sets a time period to T2*a* corresponding to the image forming apparatus A (12 ppm). If the stapler controller 2*x* in the stapler 2 receives the information of the "model ID2", sets a time period to T2*b* corresponding to the image forming apparatus B (16 ppm). The value of the maximum load current in the image forming apparatus A is smaller than that of the image forming apparatus B since the image formation speed in the image forming apparatus A is slower than that of the image forming apparatus B. In the exemplary embodiment, the maximum load current in the image forming apparatus B is 12 A, and the maximum load current in the image forming apparatus A is 11 A. In such a case, the time period T2 to be set has a relationship of T2*a*<T2*b*. If the maximum load current is smaller, the time period T2 can be set to a shorter time period. Thus, depending on the difference of the maximum load current in the image forming apparatus to which the stapler is set, the inhibited period of the stapling processing can be optimally set.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-225880 filed Oct. 5, 2010, which is hereby incorporated by reference herein in its entirety.

What is claimed is:

1. An image forming apparatus to which a stapler to perform stapling processing on a recording material is connectable, comprising:

a power source configured to supply electric current to the image forming apparatus and the stapler with the stapler being connected to the image forming apparatus; and a control unit configured to prohibit start of the stapling processing in a first time period when a current value of electric current supplied from the power source to the image forming apparatus reaches a maximum current value and in a second time period immediately before the first time period, wherein, in a case where the stapling processing starts before the second time period, the control unit sets the second time period so that a sum of the current value of the electric current supplied from the power source to the image forming apparatus and a current value of electric current supplied from the power source to the stapler is equal to or less than a limit current value in a time period when a time period of performing the stapling processing and the first time period partially overlap.

2. The image forming apparatus according to claim 1, wherein, in a case where the stapling processing starts before the second time period and the second time period starts during execution of the stapling processing, the control unit controls the stapling processing to continue, prohibits a next stapling processing when the stapling processing is completed, and permits the next processing when the first time period elapses.

3. The image forming apparatus according to claim 1, further comprising a current detection unit configured to detect the electric current flowing through the stapler, wherein the control unit detects whether the stapling processing is performed based on the electric current detected by the current detection unit.

4. The image forming apparatus according to claim 1, further comprising a sheet presence detection unit configured to detect whether the recording materials are inserted into the stapler, wherein if timing the sheet presence detection unit detects presence of the sheets is out of the first time period and the second time period, the stapling processing is performed.

5. The image forming apparatus according to claim 1, further comprising a sheet holding unit configured to hold the recording materials inserted into the stapler in the stapling processing, wherein the sheet holding unit holds the recording materials while the stapling processing is sequentially performed at a plurality of points on the recording materials.

6. A stapler connectable to an image forming apparatus to form an image on a recording material and performing stapling processing on the recording material when electric current is supplied thereto from a power source provided to the imaging forming apparatus with the stapler being connected to the image forming apparatus, the stapler comprising:

a control unit configured to prohibit start of the stapling processing in a first time period when a current value of electric current supplied from the power source to the image forming apparatus reaches a maximum current value and in a second time period immediately before the first time period, wherein, in a case where the stapling processing starts before the second time period, the control unit sets the second time period so that a sum of the current value of the electric current supplied from the power source to the image forming apparatus and a current value of the electric current supplied from the power source to the stapler is equal to or less than a limit current value in a time period when a time period of performing the stapling processing and the first time period partially overlap.

7. The stapler according to claim 6, wherein in a case where the stapling processing starts before the second time period and the second time period starts during execution of the stapling processing, the control unit controls the stapling processing to continue, prohibits a next stapling processing when the stapling processing is completed, and permits the next processing when the first time period elapses.

8. The stapler according to claim 6, further comprising a sheet presence detection unit configured to detect whether the recording materials are inserted into the stapler, wherein if timing the sheet presence detection unit detects presence of the sheets is out of the first time period and the second time period, the stapling processing is performed.

9. The stapler according to claim 6, further comprising a sheet holding unit configured to hold the recording material inserted into the stapler in the stapling processing, wherein the sheet holding unit holds the recording material while the stapling processing is sequentially implemented at a plurality of points on the recording material.

10. The stapler according to claim 6, wherein the control unit sets the second time period depending on the maximum load current of the image forming apparatus to which the stapler is connected.

11. The image forming apparatus according to claim 1, wherein the limit current value is a maximum current value supplied by the power source.

12. The stapler according to claim 6, wherein the limit current value is a maximum current value of electric current supplied by the power source.

13. An image forming apparatus to which a stapler to perform stapling processing on a recording material is connectable, comprising:

a power source configured to supply electric current to the image forming apparatus and the stapler with the stapler being connected to the image forming apparatus; and a control unit configured to prohibit start of the stapling processing in a first time period when electric current of a first current value is supplied from the power source to the image forming apparatus and in a second time period when electric current of a second current value smaller than the first current value is supplied from the power source to the image forming apparatus, the second time period being a period immediately before the first time period, wherein, in a case where the stapling processing starts before the second time period, the control unit sets the second time period so that a sum of the first current value and a current value of electric current supplied from the power source to the stapler is equal to or less than a limit current value in a time period when a time period of performing the stapling processing and the first time period partially overlap.

14. The image forming apparatus according to claim 13, wherein, when the stapling processing has started before the second time period, even if the current value of the electric current supplied from the power source to the stapler reaches a maximum current value in the second time period, a sum of the second current value and the maximum current value is equal to or less than the limit current value.

15. The image forming apparatus according to claim 13, wherein the first current value is a maximum current value of electric current supplied from the power source to the image forming apparatus during a time when the image forming apparatus performs image forming operation on a recording material.

16. The image forming apparatus according to claim 13, wherein the limit current value is a maximum current value of electric current supplied by the power source.

17. A stapler connectable to an image forming apparatus configured to form an image on a recording material and performing stapling processing on the recording material when electric current is supplied thereto from a power source provided to the imaging forming apparatus with the stapler being connected to the image forming apparatus, the stapler comprising:

a control unit configured to prohibit start of the stapling processing in a first time period when electric current of a first current value is supplied from the power source to the image forming apparatus and in a second time period when electric current of a second current value smaller than the first current value is supplied from the power source to the image forming apparatus, the second time period being a period immediately before the first time period, wherein, in a case where the stapling processing starts before the second time period, the control unit sets the second time period so that a sum of the first current value and a current value of electric current supplied from the power source to the stapler is equal to or less than a limit current value in a time period when a time period of performing the stapling processing and the first time period partially overlap.

18. The stapler according to claim 17, wherein, when the stapling processing has started before the second time period, even if the current value of electric current supplied from the power source to the stapler reaches a maximum current value in the second time period, a sum of the second current value and the maximum current value is equal to or less than the limit current value.

19. The stapler according to claim 17, wherein the first current value is a maximum current value of electric current supplied from the power source to the image forming apparatus during a time when the image forming apparatus performs image forming operation on a recording material.

20. The stapler according to claim 17, wherein the limit current value is a maximum current value of electric current supplied by the power source.

* * * * *